US007322057B2

(12) United States Patent
Merlini

(10) Patent No.: US 7,322,057 B2
(45) Date of Patent: Jan. 29, 2008

(54) TRAVEL PILLOWCASE, PILLOW SYSTEM AND KIT

(76) Inventor: Ann E. Merlini, 21 N. View Dr., Gilford, NH (US) 03249

( * ) Notice: Subject to any disclaimer, the term of this patent is extended or adjusted under 35 U.S.C. 154(b) by 204 days.

(21) Appl. No.: 11/338,927

(22) Filed: Jan. 25, 2006

(65) Prior Publication Data

US 2006/0174411 A1 Aug. 10, 2006

Related U.S. Application Data

(60) Provisional application No. 60/650,854, filed on Feb. 7, 2005.

(51) Int. Cl.
*A47G 9/02* (2006.01)
*A47G 9/10* (2006.01)

(52) U.S. Cl. ..... 5/490; 5/484; 5/639; 5/644

(58) Field of Classification Search ..... 5/490, 5/636, 639, 640, 645, 484, 644, 654, 655.3
See application file for complete search history.

(56) References Cited

U.S. PATENT DOCUMENTS 1,269,276 A * 6/1918 Harris ..... 383/4
1,677,743 A * 7/1928 Berton ..... 5/653
3,863,283 A * 2/1975 Mohr ..... 5/639
4,277,859 A * 7/1981 Seaman ..... 5/639
4,712,259 A * 12/1987 Chiasson ..... 5/644
6,189,169 B1 * 2/2001 Marcotte ..... 5/655
6,216,297 B1 * 4/2001 Lemke ..... 5/636
2006/0174411 A1 * 8/2006 Merlini ..... 5/490

* cited by examiner

*Primary Examiner*—Robert G. Santos
(74) *Attorney, Agent, or Firm*—Michael J. Persson; Lawson + Persson, P.C.

(57) ABSTRACT

A travel pillowcase, pillow system and kit. The travel pillowcase includes a first sheet of a water resistant fabric and a second sheet of a substantially flexible water resistant fabric disposed in substantially parallel relation to the first sheet. A substantial portion of the outer edges of the first and second sheets are aligned and joined together such that the first sheet and the second sheet form a pouch having an opening defined by the portions of the outer edge of the first sheet and the outer edge of the second sheet that are not joined together. A third sheet of a substantially flexible fabric that is soft and non-irritating to human skin is attached to the outside surface of the second sheet. A closure is attached to the outer surface of the first sheet for securing the pillowcase in a closed position when the pillowcase is folded.

20 Claims, 6 Drawing Sheets

TRAVEL PILLOWCASE, PILLOW SYSTEM AND KIT

CLAIM OF PRIORITY

This application claims the benefit of priority, pursuant to 35 U.S.C. 119(e), of U.S. Provisional Patent Application No. 60/650,854, filed on Feb. 7, 2005.

FIELD OF THE INVENTION

The present invention relates to the field of pillowcases and, in particular, to pillowcases adapted for use outside of the home.

BACKGROUND OF THE INVENTION

Travel can be tiring and uncomfortable. Therefore, regardless of whether a passenger is traveling in an airplane, a train, or bus, a pillow may be used to make the passenger more comfortable and allow them to rest during their journey. For this reason, most passenger carriers have pillows to provide to their passengers. However, it is common for all available pillows and/or blankets to be taken by other passengers. Further, because these pillows and blankets often come in close contact with passengers' faces and cannot be effectively sanitized between each flight, train trip or bus ride, these pillows are often so dirty and unsanitary that many passengers are hesitant to use them. Therefore, there is a need for a product that solves the problem of availability, cleanliness and sanitary integrity of the bedding and pillows that are provided to passengers by the carrier, whether such carrier is an airline, rail carrier, bus, or otherwise.

There are many companies that sell blankets and travel pillows that travelers can pack into their carry-on luggage and these travel blankets and pillows solve the problems of availability and cleanliness. However, packing multiple items takes up valuable luggage space and requires that the traveler pack and unpack these items multiple times. Accordingly, packing a conventional travel pillow is not an effective solution to this problem.

Another potential solution to the problem is for a traveler to pack a separate pillowcase in her carryon luggage. This solution allows the traveler to place a barrier between the pillow and her skin, providing some degree of protection from dirt, dandruff and other surface contaminants, and allows the user to fill the pillowcase with a blanket or soft clothing to act as a pillow in circumstances when none are available. However, cotton pillowcases do not provide sufficient protection against the spread of germs to protect the traveler from infection. Further, this solution requires the traveler to pack and unpack the pillowcase from her carryon luggage multiple times. Therefore, this solution is likewise ineffective at overcoming the problems described above.

Still another potential solution would be for the traveler to remove the contents of a carryon bag and use it as a pillowcase by inserting a carrier's pillow inside. As most carryon bags are made of materials that are impervious to the weather, this solution would likely provide an effective way to prevent the spread both of surface contaminants and of germs. However, this solution is far from ideal, as heavy-weight nylon, leather and other fabrics typically used in carryon luggage are not soft and do not provide a comfortable place upon which to rest one's head.

Therefore, there is a need for a product that solves the problem of availability, cleanliness and sanitary integrity of the bedding and pillows that are given to passengers by a carrier, that does not take up valuable luggage space, that does not require that the traveler pack and unpack items multiple times, and that provides the traveler with a comfortable surface upon which to rest her head.

SUMMARY OF THE INVENTION

The present invention provides travel pillowcase, pillow system and kit that solve the problems described above.

In its most basic form, the travel pillowcase of the present invention includes a first sheet of a water resistant fabric having an inside surface, and an outside surface defining an outer edge. A second sheet of a substantially flexible water resistant fabric is disposed in substantially parallel relation to the inside surface of the first sheet. The second sheet has an inside surface, disposed in opposing relation to the inside surface of the first sheet, and an outside surface defining an outer edge. A substantial portion of the outer edge of the second sheet is aligned with a substantial portion of the outer edge of the first sheet and is joined thereto such that the first sheet and the second sheet form a pouch having an opening defined by the portions of the outer edge of the first sheet and the outer edge of the second sheet that are not joined together. A third sheet of a substantially flexible fabric is attached to the outside surface of the second sheet. The third sheet has an inside surface, which is attached to the outside surface of the second sheet, and an outside surface manufactured of a material that is soft and non-irritating to human skin. A closure is attached to the outer surface of the first sheet for securing the pillowcase in a closed position when the pillowcase is folded.

In operation, the pillowcase is transported in a folded position with the closure being secured to maintain the pillowcase in its folded transport position. In this position, the outside surface of the first sheet is the only surface exposed to the elements and the pillowcase presents as a thin rectangular tote bag. When the traveler desires to use the pillowcase, the traveler will release the closure and unfold the pillowcase, exposing the soft third sheet and the pouch opening. The traveler will then insert a pillow through the pouch opening, where it is maintained between the first sheet and second sheet such that any contaminants cannot pass through the pillowcase to the traveler. The traveler then positions the pillowcase such that the third sheet comes into to contact with the traveler's body, such as under the neck or at the small of the back, allowing the traveler to comfortably relax.

The preferred embodiment of the travel pillowcase includes a carry strap attached to the outside surface of the first sheet. The preferred carry strap includes a pair of swivel hook members that are removably attached to a pair of loops disposed at opposite ends of a reinforcing member, which is attached to the first sheet, preferably along its midline. The use of a reinforcing member is preferred as it increases the weight of articles that maybe carried in the pillowcase, allowing the pillowcase to be utilized as a tote bag to carry personal items like a boarding pass, ID, books, electronic devices, tissues, and other items often carried by travelers during travel. The use of a carry strap is preferred as it allows the traveler's hands to be kept free during transport, while the removability of the carry strap allows the strap to prevent the pillowcase from being stuck within x-ray machines commonly used by airport security. However, other embodiments may include a carry handle formed integral to the reinforcing member, while still other embodiments eliminate both the reinforcing member, carry strap and handle altogether.

The preferred pillowcase closure is a zipper disposed about the outer edge of the first sheet. A zipper closure is preferred as it prevents any items held within the pillowcase from falling out of the pillowcase during transport. The zipper closure is especially adapted for use with a pillowcase having the preferred shape and construction. In such an embodiment, the first sheet and second sheet are substantially rectangular in shape with substantially rounded corners. The second includes three edges that substantially align with three of the four edges of the first sheet and a fourth edge that terminates within a periphery of the first sheet, with aligned edges being joined together. In these embodiments, the first sheet is essentially divided into two halves, with one half of the zipper closure being attached to the edges of one half of the first sheet and the other half of the zipper closure being attached to the other half. The pillowcase is then folded about the line separating the two halves and the zipper engaged to secure the two halves together such that only the first sheet is exposed. However, although a zipper closure is preferred, it is recognized that other types of closures, such as hook and loop fasteners, snaps, buttons, or the like may be substituted. Similarly, although a rectangular pillowcase that is folded in half is preferred due to the fact that pillows are commonly shaped as rectangles, it is recognized that pillowcases may take the form of a number of shapes, such as circles, ovals, horseshoes, ellipses, or the like in cases where pillows of different shapes are used. Further, the pillowcase may likewise be folded into thirds, fourths, etc. to achieve similar results.

The first sheet and second sheet of the travel pillowcase are preferably manufactured of the same substantially flexible nylon material, and the first sheet is preferably constructed of an inner and an outer sheet of nylon. Nylon is preferred due to its slippery nature, which allows pillows and/or blanket to be easily inserted and removed, and due to the fact that nylon is easily cleaned and disinfected. However, the first sheet in other embodiments is manufactured of more rigid weather resistant materials, such as thick leather, plastic, or heavy canvas, which may not have sufficient flexibility to be used for the second sheet. In such embodiments, the second sheet is preferably manufactured of a different material, such as nylon, flexible leather, light canvas, supplex, or taslan.

The third sheet of the preferred travel pillowcase is manufactured of a fleece fabric, which is soft, warm and will not irritate human skin. However, other embodiments may utilize different materials, such as fleece, satin, silk, cotton, or polyester. Similarly, the third sheet may take the form of a composite fabric having an inside surface that is not soft, to allow it to be easily attached to the second sheet, and an outside surface that has the necessary softness.

The preferred travel pillowcase includes a fourth sheet of fabric that is attached to the outside surface of the first sheet to form at least one pocket. In the preferred embodiment, the fourth sheet of fabric is manufactured of the same material as the first sheet and is attached to a portion of the first sheet to form a single pocket, which includes a zipper for securing the pocket in a closed position. The preferred travel pillowcase also includes a fifth sheet of fabric attached to a portion of the outside surface of the first sheet to form at least one pocket, and preferably three pockets. The fifth sheet of fabric is preferably manufactured of a mesh material and is disposed on an opposite side of the outer surface of the first sheet such that, when folded in half, one side of the folded pillowcase includes at least one mesh pocket and the other side includes a zippered pocket. In some embodiments, the mesh pockets are eliminated, in others the zippered pocket is eliminated, while still other embodiments include no pockets.

In its basic form, the travel pillow of the present invention includes the travel pillowcase in combination with an inflatable bladder disposed within the pouch formed by the second sheet and the first sheet of the pillowcase. In the preferred embodiment, the inflatable bladder is removably disposed within the pouch and may be removed to inflate or deflate it. In other embodiments, the bladder includes an inflation stem, the travel pillowcase includes an inflation stem opening through at least one of the first sheet and the second sheet, and the inflation stem extends through the inflation stem opening such that the inflatable bladder may be inflated without removing the inflatable bladder from the pouch.

In its most basic form, the travel pillow kit of the present invention includes the travel pillowcase and a blanket dimensioned for disposal within the pouch formed by the second sheet and the first sheet of the pillowcase. In some embodiments of the kit an inflatable bladder is also provided. The inflatable bladder is dimensioned for disposal within the pouch formed by the second sheet and the first sheet of the pillowcase and is in addition to the blanket.

As described above, the preferred embodiments of the present invention appear as compact, multipurpose travel packs that can be attached directly to a person's carryon luggage, slung over a shoulder or attached directly to an article of clothing. One aspect of the pillowcase kit that is unique is the novel way in which the two items, the pillowcase and blanket ate packaged. The product's compact size and unique construction method provide an easy, convenient, all in one place for an individual to transport and use these items. The outer shell becomes part of the pillowcase and the folded blanket fits neatly into the space allotted within the pillowcase. When unzipped the product can be used as a fleece topped pillow. When the blanket is removed, the traveler can insert a travel pillow provided by the carrier, one supplied by themselves, or an inflatable bladder into the pillowcase and have a complete comfort/sleep system. Finally, the water resistant or waterproof fabric shell protects the blanket and pillowcase and alleviates the need for these items to be carried in a protective bag.

Therefore, it is an aspect of the invention to provide a travel pillowcase, pillow system and kit that solve the problem of the lack of availability of pillows that are given to passengers by transportation carriers.

It is a further aspect of the invention to provide a travel pillowcase, pillow system and kit that prevent the spread of germs and other contaminants from pillows that are given to passengers by transportation carriers.

It is a further aspect of the invention to provide a travel pillowcase, pillow system and kit that do not take up valuable luggage space.

It is a further aspect of the invention to provide a travel pillowcase, pillow system and kit that do not require that the traveler pack and unpack items multiple times.

It is a further aspect of the invention to provide a travel pillowcase, pillow system and kit that provide the traveler with a comfortable surface upon which to rest her head.

It is a further aspect of the invention to provide a travel pillowcase, pillow system and kit that can act as a lumbar support pillow.

It is a further aspect of the invention to provide a travel pillowcase, pillow system and kit that can be used as a pillow, pillowcase, a place to hold a blanket, or a place to store an inflatable pillow when opened.

It is a still further aspect of the invention to provide a travel pillowcase, pillow system and kit that allow a traveler to travel more comfortably, conveniently and cleanly.

It is a still further aspect of the invention to provide a travel pillowcase, pillow system and kit that provides comfort when used as a pillow and may also be used as a tote bag to carry personal items like a boarding pass, ID, book, tissues, and other items often carried by travelers during travel.

It is a still further aspect of the invention to provide a travel pillowcase, pillow system and kit that is lightweight, compact, and easy to use.

It is a still further aspect of the invention to provide a travel pillowcase, pillow system and kit that is manufactured of materials that are easy to clean.

It is a still further aspect of the invention to provide a travel pillow kit that can be used at sporting events and function as a seat cushion.

These aspects of the invention are not meant to be exclusive and other features, aspects, and advantages of the present invention will be readily apparent to those of ordinary skill in the art when read in conjunction with the following description, appended claims and accompanying drawings.

DETAILED DESCRIPTION OF THE INVENTION

Figure 2:
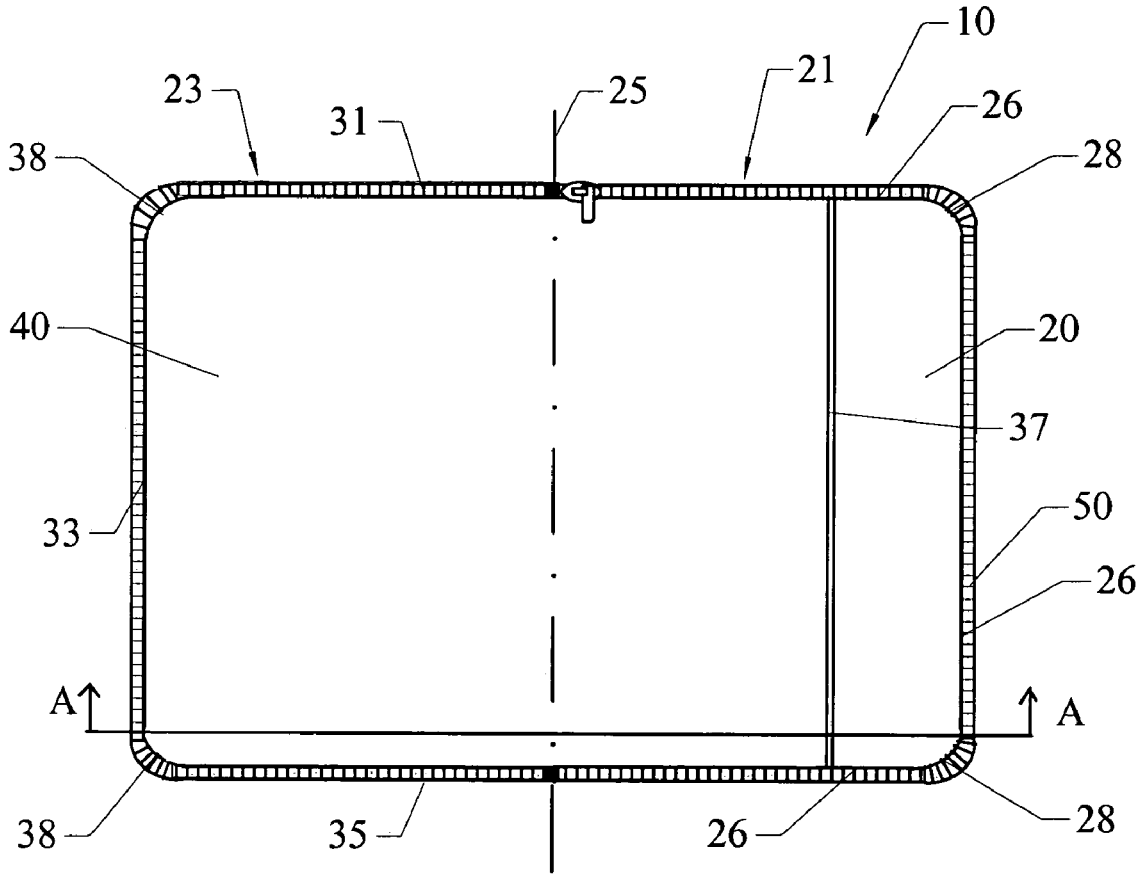
FIG. 2 is a top view of the inside of one embodiment of the travel pillowcase of the present invention in an unfolded position showing the relation between the first and third sheets of fabric.
Figure 3:
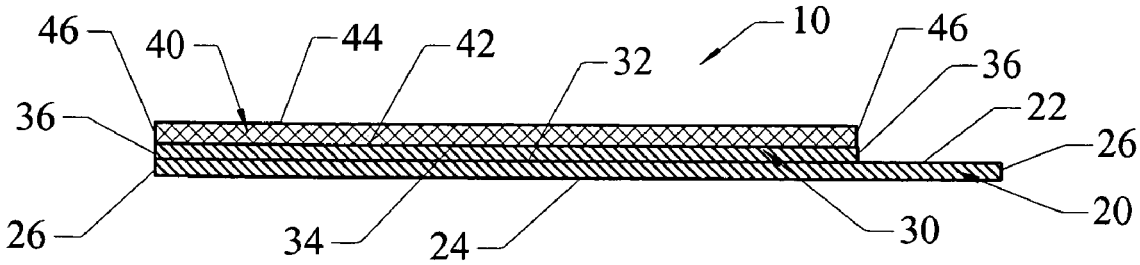
FIG. 3 is a cross sectional view of the embodiment of the travel pillowcase of FIG. 2 taken across section A-A before the edges are joined with the thicknesses of the sheets expanded to show the relation between the first sheet of fabric, the second sheet of fabric and the third sheet of fabric.
Figure 4:
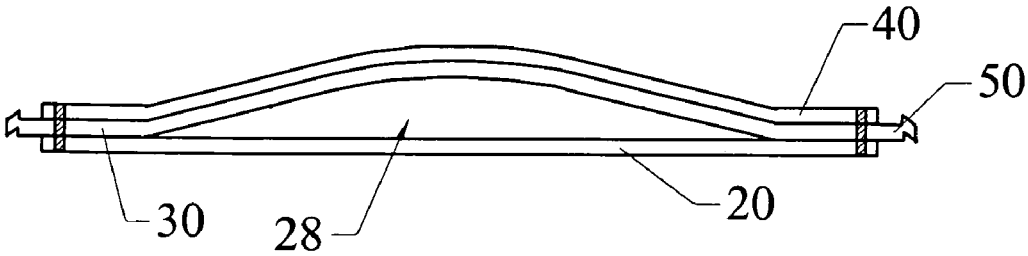
FIG. 4 is an end edge view of one embodiment of the travel pillowcase of the present invention in an unfolded position showing the opening formed between the first sheet and the second sheet between the first sheet and the second sheet.

Referring first to FIGS. 2-4, the travel pillowcase 10 of the present invention includes a first sheet 20 of a water resistant fabric having an inside surface 22, and an outside surface 24 defining an outer edge 26. A second sheet 30 of a substantially flexible water resistant fabric is disposed in substantially parallel relation to the inside surface 22 of the first sheet 20. The second sheet has an inside surface 32, disposed in opposing relation to the inside surface 22 of the first sheet, and an outside surface 34 defining an outer edge 36. A substantial portion of the outer edge 36 of the second sheet 60 is aligned with a substantial portion of the outer edge 26 of the first sheet 20 and is joined thereto such that the first sheet 20 and the second sheet 30 form a pouch having an opening 28 defined by the portions of the outer edge 26 of the first sheet 20 and the outer edge 36 of the second sheet 30 that are not joined together. A third sheet 40 of a substantially flexible fabric is attached to the outside surface 34 of the second sheet 30. The third sheet 40 has an inside surface 42, which is attached to the outside surface 34 of the second sheet 30, and an outside surface 44 manufactured of a material that is soft and non-irritating to human skin. A closure 50 is attached to the outer surface 24 of the first sheet 20 for securing the pillowcase 10 in a closed position when the pillowcase 10 is folded.

The first sheet 20 and second sheet 30 of the travel pillowcase 10 are preferably manufactured of the same substantially flexible nylon material. This is preferred due to the slippery nature of the nylon, which allows pillows and/or blankets to be easily inserted and removed, and due to the fact that nylon is easily cleaned and disinfected. However, the first sheet 20 in other embodiments is manufactured of more rigid weather resistant materials, such as thick leather, plastic, or heavy canvas, which may not have sufficient flexibility to be used for the second sheet. In such embodiments, the second sheet 30 is preferably manufactured of a different material, such as nylon, flexible leather, light canvas, supplex, or taslan, which is sufficiently flexible to allow it to conform to the traveler's body during use.

The third sheet 40 of the preferred travel pillowcase 10 is manufactured of a fleece fabric, which is soft, warm and will not irritate human skin. However, other embodiments may utilize different materials, such as fleece, satin, silk, cotton, cashmere, or polyester. Similarly, the third sheet 40 may take the form of a composite fabric having an inside surface 42 that is not soft to allow for easily attached to the second sheet 40, and an outside surface 44 that has the necessary softness.

The preferred pillowcase closure 50 is a zipper closure, such as those manufactured by YKK Corporation of America, of Atlanta, Ga., which is disposed about the outer edge 26 of the first sheet 20. A zipper closure 50 is preferred as it prevents any items held within the pillowcase 10 from falling out of the pillowcase 10 during transport. The zipper closure 50 is especially adapted for use with embodiments of the pillowcase 10, such as the embodiment of FIG. 2, which have the preferred shape and construction. In such an embodiment, the first sheet 20 is substantially rectangular in shape, having a width of approximately fifteen inches and a length of approximately twenty inches, and has four substantially rounded corners 29. The second sheet 30 and third sheet 40 include two rounded corners 39 and three edges 31, 33, 35 that substantially align with three of the four edges 26 of the first sheet 20, and a fourth edge 37 that terminates within a periphery of the first sheet 20. The aligned edges 31, 33, 35 of the second and third sheets 30, 40 are joined to the corresponding edges 26 of the first sheet 20.

In the preferred embodiment, the pillowcase 10 is essentially divided into two halves 21, 23 with one half of the zipper closure 50 being attached to the edges 26 of the first sheet 20 of one half 21, 23 and the other half of the zipper closure 50 being attached to the edges 26 of the first sheet 20 of the other half 21, 23. The pillowcase 10 is then folded about a line 25 separating the two halves 21, 23 and the zipper closure 50 engaged to secure the two halves 21, 23 together such that only the first sheet 20 is exposed. However, although a zipper closure 50 is preferred, it is recognized that other types of closures, such as hook and loop fasteners, snaps, buttons, or the like may be substituted to achieve similar results. Similarly, although a rectangular pillowcase 10 that is folded in half is preferred due to the fact that pillows are commonly shaped as rectangles, it is recognized that pillowcase 10 maybe formed into a number of shapes, such as circles, ovals, horseshoes, ellipses, or the like, in cases where pillows of different shapes are used. Further, the pillowcase 10 may likewise be folded into thirds, fourths, etc. to achieve similar results.

Figure 1A:
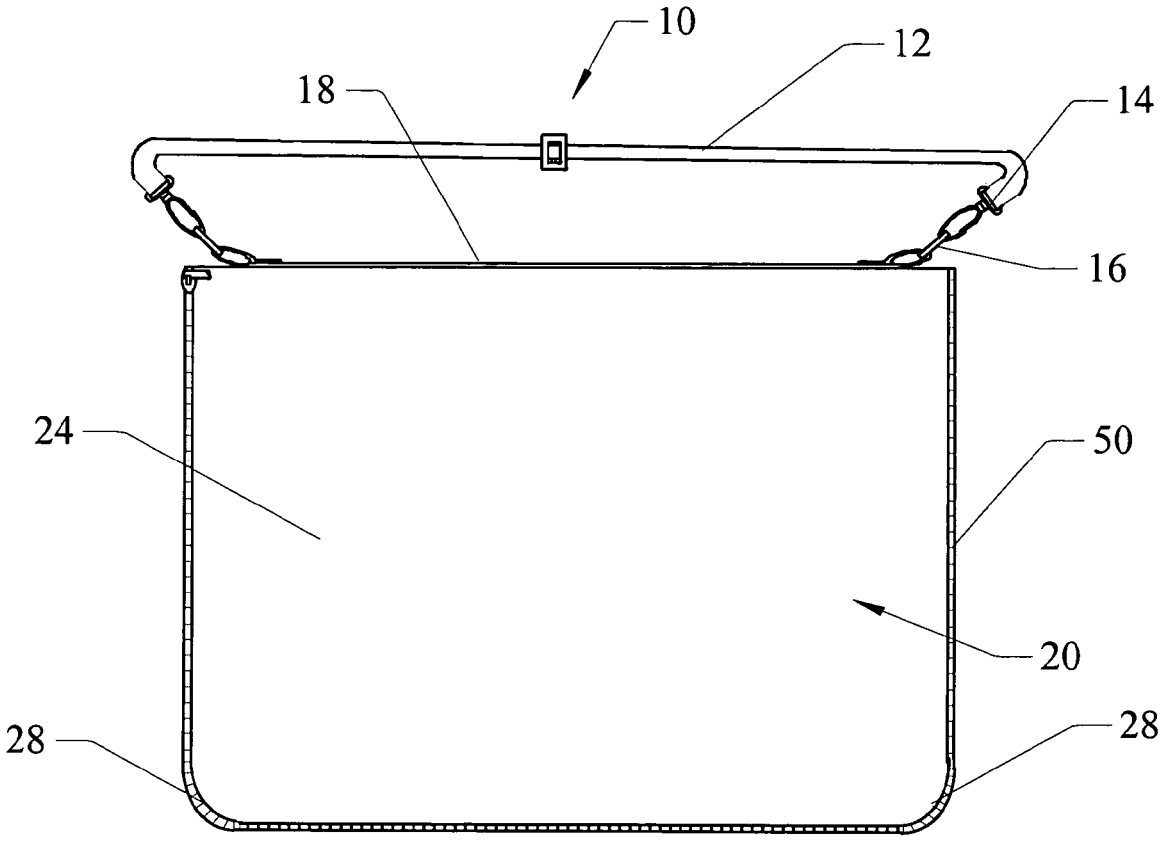
FIG. 1A is a top view of the one embodiment of the travel pillowcase of the present invention in a folded position with a carry strap attached.
Figure 1B:
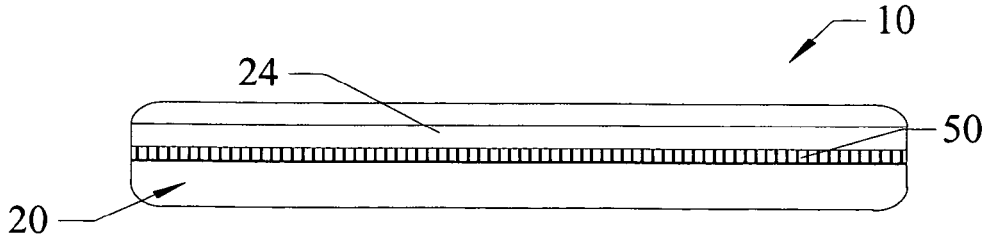
FIG. 1B is an end edge view of the embodiment of the travel pillowcase of FIG. 1A.

As shown in FIGS. 1A and 1B, the pillowcase 10 is transported in a folded position with the closure 50 secured to maintain the pillowcase 10 in its folded transport position. In this position, the outside surface of the first sheet is the only surface exposed to the elements and the pillowcase presents as a thin rectangular tote bag. When the traveler desires to use the pillowcase 10, the traveler will release the closure 50 and unfold the pillowcase 10, exposing the soft third sheet 50 and the pouch opening 28. The traveler will then insert a pillow (not shown) through the pouch opening 28, where it is maintained between the first sheet 20 and second sheet 30 such that any contaminants cannot pass through the pillowcase 10 to the traveler. The traveler then positions the pillowcase 10 such that the third sheet 50 comes into to contact with the traveler's body (not shown), such as under the neck or at the small of the back, allowing the traveler to comfortably relax.

In some embodiments, the closure 50 is a reversible zipper closure, which allows the pillowcase 10 to be folded and secured with either the first sheet 20 or the third sheet 40 on the exterior. In such embodiments, a traveler could transport the pillowcase 10 with the outside surface 24 of the first sheet 20 exposed, unzip and open the pillowcase 10, insert a pillow into one half of the pillowcase, and then re-zip the pillowcase 10 in the reversed position such that the soft outside surface 44 of the third sheet 40 is exposed. This provides the traveler with two soft sides, allowing for the traveler to flip the pillow when one side becomes warm and eliminates the "flap" of the first sheet 20 that extends beyond the unsecured edge of the third sheet 40.

As shown in FIG. 1A, the preferred travel pillowcase 10 of the present invention includes a carry strap 12 that may be slung over a shoulder of a user. The preferred carry strap 12 is manufactured of a nylon webbing includes a pair of swivel hook members 14 that are removably attached to a pair of loops 16 at opposite ends of a reinforcing member 18 that is attached to the first sheet 20, preferably the midline 25 of the pillowcase 10. As shown more clearly in FIG. 5, the loops 16 attached to the reinforcing member 18 are preferably triangular in shape, but may take a number of different forms. The use of a carry strap 12 is preferred as it allows the user's hands to be kept free during transport, while the removability of the carry strap 12 allows the strap to be removed while passing through security checkpoints, effectively preventing the pillowcase from being stuck within x-ray machines commonly used by airport security. However, other embodiments may include a carry handle (not shown) formed integral to the reinforcing member 18, while still other embodiments eliminate both the reinforcing member 18, carry strap 12 and handle altogether.

The preferred reinforcing member 18 is manufactured of nylon webbing that has a body that is sewed to the first sheet 12 and ends that are threaded through the loops 16 and permanently secured to the body of the reinforcing member 18. The use of a reinforcing member 18 is preferred as it increases the weight of articles that may be carried in the pillowcase 10, allowing the pillowcase 10 to be utilized as a tote bag to carry personal items like a boarding pass, ID, books, electronic devices, tissues, and other items often carried by travelers during travel. However, as noted above, the reinforcing member 18 may be eliminated in some embodiments.

Figure 5:
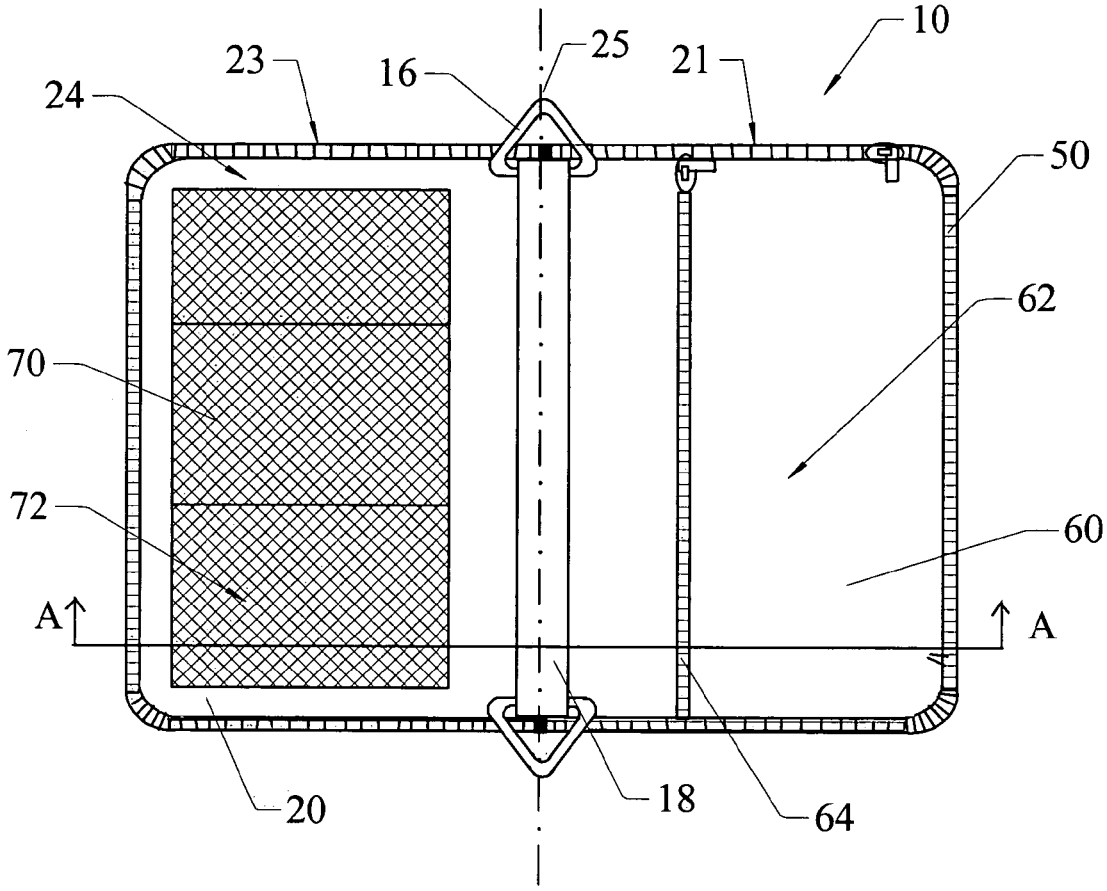
FIG. 5 is a top view of the preferred embodiment of the travel pillowcase of the present invention in an unfolded position with the carry strap removed.
Figure 6:
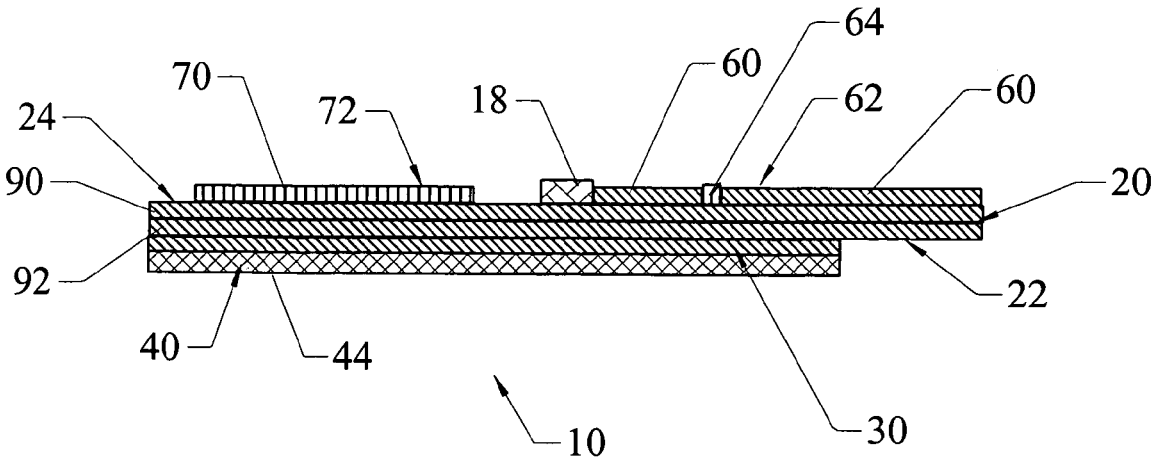
FIG. 6 is a cross sectional view of the preferred embodiment of the travel pillowcase of FIG. 5 taken across section A-A before the edges are joined with the thicknesses of the sheets expanded to show the relation between the sheets of fabric.

As shown in FIGS. 5 and 6, the preferred travel pillowcase 10 includes a fourth sheet 60 of fabric that is attached to the outside surface 24 of the first sheet 20 to form at least one pocket 62. In the preferred embodiment, the fourth sheet 60 of fabric is manufactured of the same material as the first sheet 20 and is attached to a portion of the first sheet 20 to form a single pocket 62, which includes a zipper pocket closure 64 for securing the pocket 62 in a closed position. A zipper pocket closure 64 is preferred as it prevents any items held within the pocket 62 from falling out during transport, allowing a traveler to store important items, such as wallets, passports, tickets, and the like, in an easily accessible location without fear of them being lost. However, in some embodiments, the pocket closure 64 takes the form of one or more snaps, hook and loop fasteners, buttons or other art recognized means for closing a pocket, while others eliminate the pocket closure 64 completely.

As also shown in FIGS. 5 and 6, the preferred travel pillowcase 10 also includes a fifth sheet 70 of fabric attached to a portion of the outside surface 24 of the first sheet 20 to form at least one, and preferably three, pockets 72. The fifth sheet 70 of fabric is preferably manufactured of a mesh material and is disposed on an opposite side of the outer surface 24 of the first sheet 20 from the side upon which the fourth sheet 60 is disposed such that, when folded in half, one side 23 of the folded pillowcase 10 includes at least one mesh pocket 72 and the other side 21 includes a zippered pocket 62. In some embodiments, the mesh pockets 72 are eliminated, in others the zippered pocket 62 is eliminated, while still other embodiments, such as the embodiment of FIG. 1, include no pockets 72, 62 and items are merely inserted within the opening 28 between the first sheet 20 and second sheet 30 of the pillowcase 10 and secured within the pouch during transport.

Finally, as shown in FIG. 6, the first sheet 20 of the preferred pillowcase 10 is actually made up of an outer sheet 90 and an inner sheet 92 of fabric, which is preferred due to the additional durability and the protection against the elements that a dual layer sheet provides. In the preferred embodiment, the two sheets 90, 92 are manufactured of the same nylon material and are not laminated to one another but rather are attached only about their edges 26. However, in other embodiments, the outer sheet 90 and inner sheet 92 are manufactured of different materials. For example, in embodiments in which the outer sheet 90 is manufactured of leather, suede or another material having a non-slippery inside surface, the inner sheet 92 is preferably manufactured of nylon in order to allow the pillow to slide easily between the first sheet 20 and second sheet 30. In some such embodiments, the inner sheet 92 is laminated to the outer sheet 90 using adhesives, while other are merely joined about the edges as described above.

Figure 7:
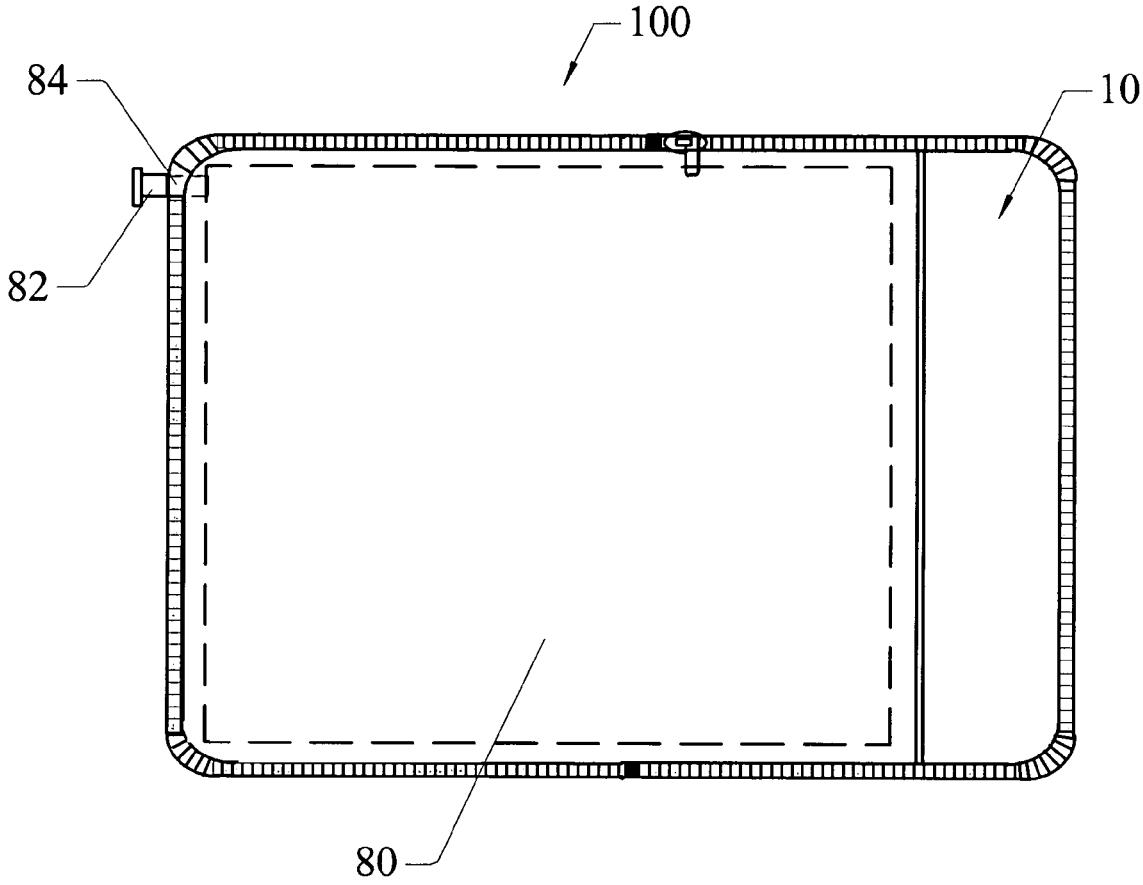
FIG. 7 is a top view of the inside of one embodiment of the travel pillow system of the present invention in an unfolded position with hidden lines showing an inflatable bladder disposed therein.

Turning now to FIG. 7, the travel pillow 100 of the present invention includes the travel pillowcase 10 in combination with an inflatable bladder 80 disposed within the pouch formed by the second sheet 30 and the first sheet 20 of the pillowcase 10. The inflatable bladder 80 is dimensioned to fit within pouch and includes an inflation stem 82 through which the traveler may blow air to inflate the bladder 80 to the desired firmness. In the preferred embodiment, the inflatable bladder 80 is substantially rectangular in shape and is removably disposed within the pouch such that it may be removed to inflate or deflate it. In other embodiments, the bladder 80 includes an extended inflation stem 82, and the travel pillowcase includes an inflation stem opening 84 through at least one of the first sheet 20, the second sheet 30 and the third sheet 40, and the inflation stem 82 extends through the inflation stem opening 84 such that the inflatable bladder 80 may be inflated without removing the inflatable bladder 80 from the pouch. In such embodiments, the bladder maybe permanently attached to the first sheet 20 or second sheet 30, may be removably attached using hook and loop fasteners, or may not be attached at all.

Figure 8:
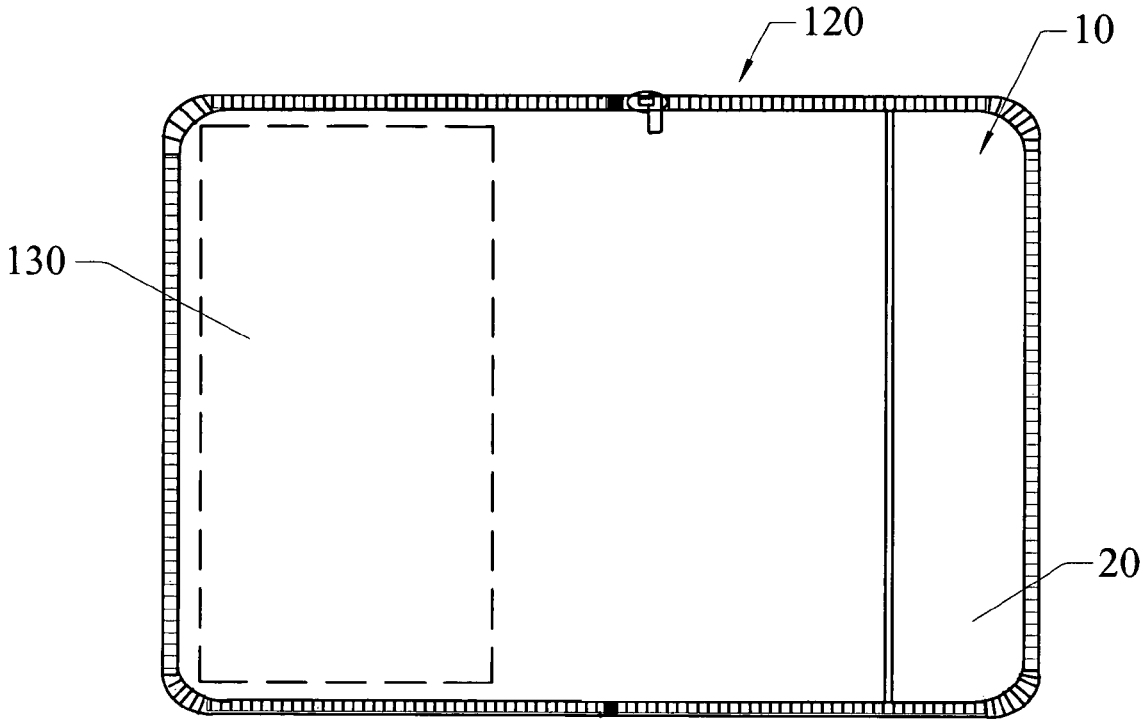
FIG. 8 is a top view of the inside of one embodiment of the travel pillow kit of the present invention in an unfolded position with hidden lines showing a blanket disposed therein.

Referring now to FIG. 8, the travel pillow kit 120 of the present invention includes the travel pillowcase 10 and a blanket 130 dimensioned for disposal within the pouch formed by the second sheet 30 and the first sheet 20 of the pillowcase 10. The preferred blanket 130 is a polyester fleece blanket having an unfolded dimension of fifty inches by sixty inches. However, blankets 130 manufactured of other materials, and/or of different dimensions maybe substituted to achieve similar results. In some embodiments of the kit 120, the inflatable bladder 80 of the travel pillow 100 is also provided. In these embodiments, the inflatable bladder 80 is also dimensioned for disposal within the pouch formed by the second sheet and the first sheet of the pillowcase and is in addition to the blanket 130.

Figure 9:
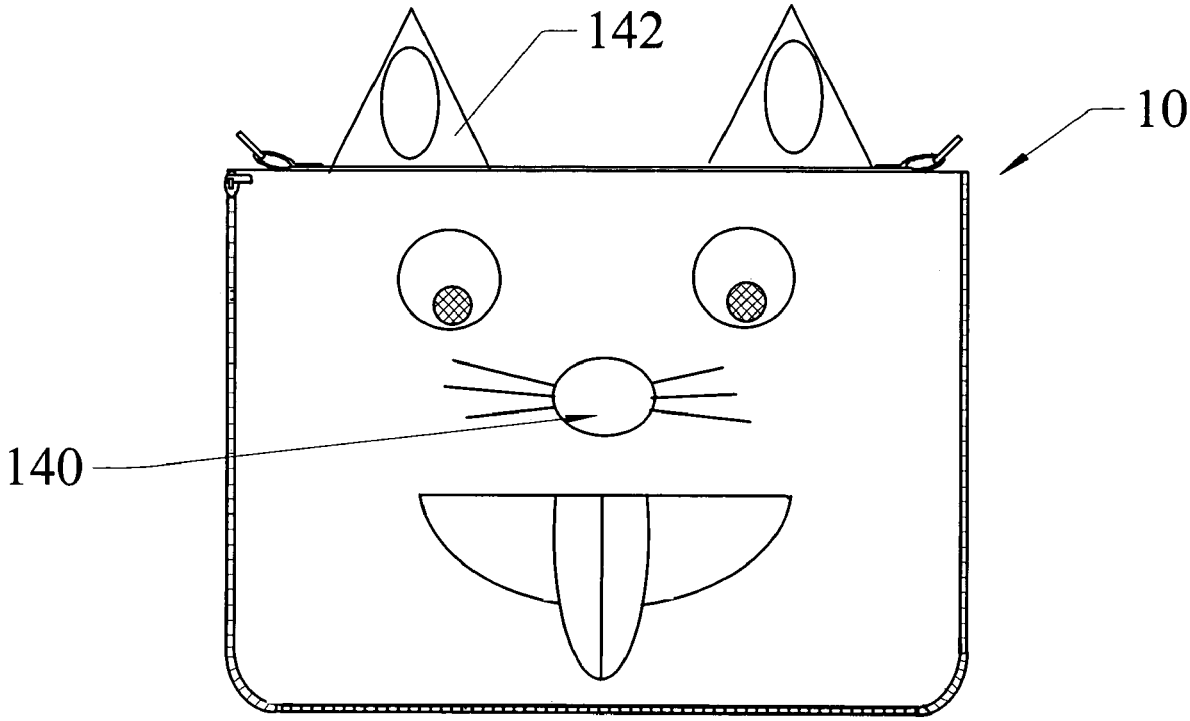
FIG. 9 is a top view of an embodiment of the travel pillowcase of the present invention adapted for use by children in a folded position with a carry strap removed.

Finally, FIG. 9 shows an embodiment of the travel pillowcase 10 for use with children. These embodiments preferably have first sheets manufactured of plush materials rather than weather resistant materials and will include faces of animals, such as the cat face 140 shown in FIG. 9, but may also include cartoon characters, shapes, or other designs that will appeal to children. They may also include additional sheets of material for purposes of ornamentation, such as those used to form the ears 142 in the embodiment of FIG. 9.

In other embodiments, the travel pillowcase 10 is adapted for use as a promotional or premium item. Such embodiments will include a logo of a sporting team, company, or the like, on the outside surface 10 of the first sheet 20.

Although the present invention has been described in considerable detail with reference to certain preferred versions thereof, other versions would be readily apparent to those of ordinary skill in the art. Therefore, the spirit and scope of the appended claims should not be limited to the description of the preferred versions contained herein.

What is claimed is:

1. A travel pillowcase comprising:

a first sheet of a water resistant fabric having an inside surface, and an outside surface defining an outer edge;

a second sheet of a substantially flexible water resistant fabric having an inside surface and an outside surface defining an outer edge, wherein said inside surface of said second sheet is disposed in substantially parallel and opposing relation to said inside surface of said first sheet, wherein a substantial portion of said outer edge of said second sheet is aligned with a substantial portion of said outer edge of said first sheet, and wherein said substantial portion of said outer edge of said second sheet that is aligned with said substantial portion of said outer edge of said first sheet is joined thereto such that said first sheet and said second sheet form a pouch having an opening defined by said portions of said outer edge of said first sheet and said outer edge of said second sheet that are not joined together;

a third sheet of a substantially flexible fabric having an inside surface and an outside surface, wherein said inside surface of said third sheet is attached to said outside surface of said second sheet, and wherein at least said outside surface of said third sheet is soft and non-irritating to human skin; and a closure attached to said outer surface of said first sheet for securing said pillowcase in a closed position when said pillowcase is folded.

2. The travel pillowcase as claimed in claim 1 further comprising a carry strap attached to said outside surface of said first sheet.

3. The travel pillowcase as claimed in claim 2 further comprising a reinforcing member attached across a midpoint of said outside surface of said first sheet, and a pair of loops attached at opposite ends of said reinforcing member, wherein said carry strip comprises a pair of swivel hook members, and wherein said swivel hook members are removably attached to said pair of loops.

4. The travel pillowcase as claimed in claim 1 wherein said closure comprises a zipper disposed about said outer edge of said first sheet.

5. The travel pillowcase as claimed in claim 1 wherein said first sheet comprises an inner sheet and an outer sheet, wherein said inner sheet and said outer sheet each are substantially rectangular in shape with four substantially rounded corners, wherein said inner sheet comprises four edges that substantially align with four edges of said outer sheet, wherein said second sheet is substantially rectangular in shape with two substantially rounded corners, wherein said second sheet comprises three edges that substantially align with three of said four edges of said inner sheet and said outer sheet of said first sheet and a fourth edge that terminates within a periphery of said first sheet, and wherein said edges of said first sheet and said second sheet that are aligned are joined together.

6. The travel pillowcase as claimed in claim 1 wherein said first sheet and said second sheet are manufactured of a fabric selected from a group consisting of nylon, leather, supplex, taslan, and canvas.

7. The travel pillowcase as claimed in claim 1 wherein said third sheet is manufactured of a fabric selected from a group consisting of fleece, satin, silk, cotton, and polyester.

8. The travel pillowcase as claimed in claim 1 further comprising a fourth sheet of fabric attached to said outside surface of said first sheet to form at least one pocket.

9. The travel pillowcase as claimed in claim 8 wherein said fourth sheet of fabric is manufactured of the same material as said first sheet and is attached to a portion of said first sheet to form a single pocket, and wherein said pillowcase further comprises a zipper attached to said fourth sheet for securing said pocket in a closed position.

10. The travel pillowcase as claimed in claim 9 further comprising a fifth sheet of fabric attached to a portion of said outside surface of said first sheet to form at least one pocket, wherein said fifth sheet of fabric is manufactured of a mesh material.

11. The travel pillowcase as claimed in claim 8 wherein said fourth sheet of fabric is manufactured of a mesh material.

12. A travel pillow system comprising:

a travel pillowcase comprising:

a first sheet of a water resistant fabric having an inside surface, and an outside surface defining an outer edge;

a second sheet of a substantially flexible water resistant fabric having an inside surface and an outside surface defining an outer edge, wherein said inside surface of said second sheet is disposed in substantially parallel and opposing relation to said inside surface of said first sheet, wherein a substantial portion of said outer edge of said second sheet is aligned with a substantial portion of said outer edge of said first sheet, and wherein said substantial portion of said outer edge of said second sheet that is aligned with said substantial portion of said outer edge of said first sheet is joined thereto such that said first sheet and said second sheet form a pouch having an opening defined by said portions of said outer edge of said first sheet and said outer edge of said second sheet that are not joined together;

a third sheet of a substantially flexible fabric having an inside surface and an outside surface, wherein said inside surface of said third sheet is attached to said outside surface of said second sheet, and wherein at least said outside surface of said third sheet is soft and non-irritating to human skin; and a closure attached to said outer surface of said first sheet for securing said pillowcase in a closed position when said pillowcase is folded; and an inflatable bladder disposed within said pouch formed by said second sheet and said first sheet of said pillowcase.

13. The travel pillow system as claimed in claim 12 wherein said closure of said pillowcase comprises a zipper disposed about said outer edge of said first sheet.

14. The travel pillow system as claimed in claim 12 wherein said first sheet of said pillowcase comprises an inner sheet and an outer sheet, wherein said inner sheet and said outer sheet each are substantially rectangular in shape with four substantially rounded corners, wherein said inner sheet comprises four edges that substantially align with four edges of said outer sheet, wherein said second sheet is substantially rectangular in shape with two substantially rounded corners, wherein said second sheet comprises three edges that substantially align with three of said four edges of said inner sheet and said outer sheet of said first sheet and a fourth edge that terminates within a periphery of said first sheet, and wherein said edges of said first sheet and said second sheet that are aligned are joined together.

15. The travel pillow system as claimed in claim 12, wherein said pillowcase further comprises a fourth sheet of fabric attached to said outside surface of said first sheet to form at least one pocket.

16. The travel pillow system as claimed in claim 12 wherein said inflatable bladder is removably disposed within said pouch.

17. The travel pillow system as claimed in claim 12 wherein said inflatable bladder comprises an inflation stem, wherein said travel pillowcase comprises an inflation stem opening through at least one of said first sheet and said second sheet, and wherein said inflation stem extends through said inflation stem opening such that said inflatable bladder may be inflated without removing said inflatable bladder from said pouch.

18. A travel pillow kit comprising:

a travel pillowcase comprising:

a first sheet of a water resistant fabric having an inside surface, and an outside surface defining an outer edge;

a second sheet of a substantially flexible water resistant fabric having an inside surface and an outside surface defining an outer edge, wherein said inside surface of said second sheet is disposed in substantially parallel and opposing relation to said inside surface of said first sheet, wherein a substantial portion of said outer edge of said second sheet is aligned with a substantial portion of said outer edge of said first sheet, and wherein said substantial portion of said outer edge of said second sheet that is aligned with said substantial portion of said outer edge of said first sheet is joined thereto such that said first sheet and said second sheet form a pouch having an opening defined by said portions of said outer edge of said first sheet and said outer edge of said second sheet that are not joined together;

a third sheet of a substantially flexible fabric having an inside surface and an outside surface, Wherein said inside surface of said third sheet is attached to said outside surface of said second sheet, and wherein at least said outside surface of said third sheet is soft and non-irritating to human skin; and a closure attached to said outer surface of said first sheet for securing said pillowcase in a closed position when said pillowcase is folded; and a blanket dimensioned for disposal within said pouch formed by said second sheet and said first sheet of said pillowcase.

19. The travel pillow kit as claimed in claim 18 further comprising an inflatable bladder dimensioned for disposal within said pouch formed by said second sheet and said first sheet of said pillowcase.

20. The travel pillow kit as claimed in claim 18:

wherein said first sheet of said pillowcase comprises an inner sheet and an outer sheet, wherein said inner sheet and said outer sheet each are substantially rectangular in shape with four substantially rounded corners, wherein said inner sheet comprises four edges that substantially align with four edges of said outer sheet, wherein said second sheet is substantially rectangular in shape with two substantially rounded corners, wherein said second sheet comprises three edges that substantially align with three of said four edges of said inner sheet and said outer sheet of said first sheet and a fourth edge that terminates within a periphery of said first sheet, and wherein said edges of said first sheet and said second sheet that are aligned are joined together wherein said closure of said pillowcase comprises a zipper disposed about said outer edge of said first sheet; and wherein said pillowcase further comprises a fourth sheet of fabric attached to said outside surface of said first sheet to form at least one pocket.

* * * * *